US005536628A

United States Patent [19]

Wang et al.

[11] Patent Number: 5,536,628

[45] Date of Patent: Jul. 16, 1996

[54] AQUEOUS COATING COMPOSITIONS CONTAINING DYE-IMPREGNATED POLYMERS

[75] Inventors: Yongcai Wang; Charles C. Anderson, both of Penfield; Kurt M. Schroeder, Rochester, all of N.Y.

[73] Assignee: Eastman Kodak Company, Rochester, N.Y.

[21] Appl. No.: 352,015

[22] Filed: Dec. 8, 1994

[51] Int. Cl.[6] ..... G03C 1/32

[52] U.S. Cl. ..... 430/531; 430/215; 430/527; 430/533; 430/961; 428/327

[58] Field of Search ..... 430/531, 527, 430/523, 215, 961; 428/327

[56] References Cited

U.S. PATENT DOCUMENTS

| | | | |
|---|---|---|---|
| 3,018,272 | 1/1962 | Grifton et al. | 528/293 |
| 3,642,480 | 2/1972 | Vrancken | 430/294 |
| 3,929,489 | 12/1975 | Arcesi et al. | 430/278 |
| 4,069,186 | 1/1978 | Ramig | 523/222 |
| 4,134,872 | 1/1979 | Lee | 524/460 |
| 4,307,174 | 12/1981 | Noonan et al. | 430/215 |
| 4,394,442 | 7/1983 | Miller | 430/532 |
| 4,419,437 | 12/1983 | Noonan et al. | 430/270 |
| 4,420,555 | 12/1983 | Krueger et al. | 430/507 |
| 4,478,907 | 10/1984 | Van Gossum et al. | 430/532 |
| 4,478,974 | 10/1984 | Lee et al. | 524/533 |
| 4,497,917 | 2/1985 | Upson et al. | 523/201 |
| 4,510,204 | 4/1985 | Duke et al. | 428/463 |
| 4,543,386 | 9/1985 | Padget et al. | 524/523 |
| 4,543,387 | 9/1985 | Padget et al. | 524/523 |
| 4,567,099 | 1/1986 | Van Gilder et al. | 428/327 |
| 4,613,633 | 9/1986 | Sekiya et al. | 523/201 |
| 4,683,269 | 7/1987 | Aksman | 525/258 |
| 4,704,309 | 11/1987 | Coney et al. | 427/258 |
| 4,738,785 | 4/1988 | Langston | 210/738 |
| 4,826,907 | 5/1989 | Murso et al. | 524/394 |
| 4,847,316 | 7/1989 | Schick et al | 524/88 |
| 4,880,867 | 11/1989 | Gobel et al. | 524/507 |
| 4,883,706 | 11/1989 | Grosjean | 428/215 |
| 4,883,714 | 11/1989 | Stockl et al. | 428/412 |
| 4,954,559 | 9/1990 | Den Hartog et al. | 524/507 |
| 5,006,413 | 4/1991 | Den Hartog et al. | 428/463 |
| 5,006,451 | 4/1991 | Anderson et al. | 430/527 |
| 5,340,676 | 8/1994 | Anderson et al. | 430/63 |
| 5,366,855 | 11/1994 | Anderson et al. | 430/530 |

FOREIGN PATENT DOCUMENTS

| | | |
|---|---|---|
| 0466409A1 | 7/1991 | European Pat. Off. . |

*Primary Examiner*—Hoa Van Le

*Attorney, Agent, or Firm*—Robert A. Gerlach

[57] ABSTRACT

An imaging element comprising a support, at least one light-sensitive layer and at least one coalesced layer of film-forming colloidal polymeric particles and non-film-forming colloidal polymeric particles, one of which contains a light-absorbing dye.

17 Claims, No Drawings

AQUEOUS COATING COMPOSITIONS CONTAINING DYE-IMPREGNATED POLYMERS

BACKGROUND OF THE INVENTION

1. Field of the Invention

This invention relates to an imaging element and in particular a photographic imaging element having a dyed non-imaging layer.

It is conventional practice to incorporate an absorbing dye into a non-imaging layer in a photographic element to absorb light in a specific wavelength region. The dyed non-imaging layer is used, for example, to control spectral composition of light incident upon a photographic emulsion layer, to act as an antihalation layer between the support and the photographic emulsion layer or on the side of the support opposite to the photographic emulsion layer to prevent halation caused by light scattering during and after the passage of light through the photographic emulsion layer, and to absorb or remove ultraviolet light produced by static discharge, which can occur during the separation of the front and back side of an imaging element at relatively low humidity.

Different methods for incorporating an absorbing dye into a non-imaging layer have been described including the dispersion of an oil soluble dye with a high boiling organic solvent. However, when such dispersions in high boiling organic solvents are used, the dyed non-imaging layer is softened and the mechanical strength of the layer is lowered. Furthermore, many dyes themselves are liquid, and they therefore can have a detrimental effect on the mechanical properties of the layer and adhesion with the adjacent layers.

Efforts to reduce such detrimental effects include the use of particulate dye dispersions, the impregnation of polymer latices with hydrophobic material such as dye and the emulsifying and dispersing of a mixed solution containing an oil soluble dye and a water-insoluble, organic solvent soluble polymer. There is a need for improved light absorbing non-imaging layers in imaging elements having excellent physical and mechanical properties.

SUMMARY OF THE INVENTION

The invention provides an imaging element comprising a support, at least one light-sensitive layer and at least one light-absorbing layer, said light-absorbing layer comprising a coalesced layer of film-forming colloidal polymeric particles and non-film-forming colloidal polymeric particles, at least the film-forming colloidal polymeric particles or the non-film-forming colloidal polymeric particles contains a light-absorbing dye.

The invention thus provides, elements containing a light-absorbing dye layer suitable for controlling spectral composition of incident light upon the element, to serve as an antihalation layer, to absorb or remove ultraviolet light, which layer can be applied from an aqueous coating composition, the layer having excellent physical and chemical properties.

DESCRIPTION OF THE PREFERRED EMBODIMENTS

While the invention is applicable to all types of imaging elements, such as, thermal imaging elements, electrophotographic elements, vesicular elements, and the like, the invention is particularly applicable for use in photographic elements which, for the purpose of simplicity of explanation, will be referred to hereinafter.

In the preparation of the light-absorbing dye layers in accordance with this invention, a coating composition comprising a continuous aqueous phase having dispersed therein a mixture of film-forming colloidal polymeric particles and non-film-forming colloidal polymeric particles, at least one of which contains a light-absorbing dye is applied in the relative position of the imaging element in order to serve the particular function for which it is intended. The film-forming colloidal particles and the non-film-forming polymeric particles are present in the coating composition in a discontinuous phase. After drying, the coating composition forms a coalesced layer having superior physical properties including transparency, toughness necessary for providing resistance to scratches, abrasion, blocking, and ferro-typing, and uniform light-absorbing characteristics attributable to the nature of the dye incorporated therein.

Whether the colloidal polymeric particles are film-forming or non-film-forming is determined by the following test which must be conducted for any given type of particle after the light absorbing dye has impregnated the colloidal polymeric particles: this is a requirement because the presence of the dye in some non-film-forming colloidal polymeric particles can so effect the viscoelastic properties of such particles so as to transform the particles from non-film-forming to film-forming when the following test is applied:

An aqueous coating formulation of three percent by weight of dye containing colloidal polymeric particles, free of organic solvent or any coalescing aid, is applied to a sheet of polyethylene terephthalate in a wet coverage of 10 ml/m$^2$ and dried for two minutes at 75° C. Polymers that form clear, transparent, continuous films under these conditions are film-forming, while those that do not form clear, transparent, continuous films are non-film-forming, for the purpose of this invention.

After the test set forth above is conducted in order to determine the characteristic of any given type of colloidal polymeric particle, the aqueous coating composition is made up of from about 20 to 70 percent of the total weight of the particles of film-forming colloidal polymeric particles and 30 to 80 percent by weight of non-film-forming colloidal particles. The solid, water insoluble particles of both the film-forming and non-film-forming polymers have an average particle size of from about 10 to 500 nm, preferably from 10 to 200 nm. The film-forming polymer is present in the coalesced layer in the same weight percentage as present in the coating composition, that is, the film-forming polymer should be present in the coating composition in an amount of from about 20 to 70 percent by weight based on the total weight of the film-forming and non-film-forming particles present in the coating composition and preferably from 30 to 50 percent by weight. Thus, the coalesced layer will contain the same percentage of film-forming and non-film-forming particles as present in the coating composition. Other additional compounds may be added to the coating composition, depending on the function that the light-absorbing layer is to serve, such as, rheology modifiers, surfactants, emulsifiers, coating aids, cross-linking agents, inorganic fillers, pigments, magnetic particles, biocides and the like. The coating composition may also include small amounts of organic solvents, preferably the concentration of the organic solvent is less than 1 weight percent of the total coating composition.

Non-film-forming colloidal polymeric particles are generally comprised of glassy polymers that provide resistance to blocking, ferrotyping, abrasion and scratches. However, care should be taken when the light-absorbing dye is incorporated into what is generally perceived as a non-film-forming polymer to ensure that it is non-film-forming in accordance with the above test when the dye is incorporated therein. The non-film-forming polymer is present in the coating composition and in the coalesced layer in an amount of from 30 to 80 and preferably from 50 to 70 percent based on the total weight of the film-forming polymer and non-film-forming polymer. Non-film-forming polymers generally include addition-type polymers and interpolymers prepared from ethylenically unsaturated monomers, such as, acrylates including acrylic acid, methacrylates including methacrylic acid, acrylamides and methacrylamides, itaconic acid and its half esters and diesters, styrenes including substituted styrenes including substituted styrenes, acrylonitrile and methacrylonitrile, vinyl acetates, vinyl ethers, vinyl and vinylidene halides, and olefins. In addition, cross-linking and graft-linking monomers such as 1,4-butyleneglycol methacrylate, trimethylolpropane triacrylate, allyl methacrylate, diallyl phthalate, divinyl benzene, and the like may be used. Other polymers that may comprise the non-film-forming polymer include water-dispersible condensation polymers such as polyesters, polyurethanes, polyamides, and epoxies. Suitable non-film-forming polymeric particles do not give transparent, continuous films upon drying when the above-described test is applied, even when the light-absorbing dye is present therein.

The film-forming polymer comprises polymers that form a continuous film under the extremely fast drying conditions typical of the photographic film manufacturing process. The film-forming polymers qualify as such under the test set forth above. When the film-forming polymer contains a light-absorbing dye, the polymer in this form must qualify as "film-forming" when the above test is applied. Polymers that are suitable are those that give transparent, continuous films when the above-described test is applied and include addition-type polymers and interpolymers prepared from ethylenically unsaturated monomers such as acrylates including acrylic acid, methacrylates including methacrylic acid, acrylamides and methacrylamides, itaconic acid and its half esters and diesters, styrenes including substituted styrenes, acrylonitrile and methacrylonitrile, vinyl acetates, vinyl ethers, vinyl and vinylidene halides, and olefins. In addition, cross-linking and graft-linking monomers such as 1,4-butyleneglycol methacrylate, trimethylolpropane triacrylate, allyl methacrylate, diallyl phthalate, divinyl benzene, and the like may be used. Other suitable polymers useful as film-forming are dispersions of polyurethanes or polyesterionomers.

Preparation of polyurethane dispersions is well known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion.

The term polyesterionomer refers to polyesters that contain at least one ionic moiety. Such ionic moieties function to make the polymer water dispersible. These polyesters are prepared by reacting one or more dicarboxylic acids or their functional equivalents such as anhydrides, diesters, or diacid halides with one or more diols in melt phase polycondensation techniques as described in U.S. Pat. Nos. 3,018,272; 3,929,489; 4,307,174; and 4,419,437; incorporated herein by reference. Examples of this class of polymers include, for example, Eastman AQ polyesterionomers, manufactured by Eastman Chemical Company.

Typically the ionic moiety is provided by some of the dicarboxylic acid repeat units, the remainder of the dicarboxylic acid repeat units are nonionic in nature. Such ionic moieties can be anionic or cationic, but, anionic moieties are preferred for the present invention. Preferably, the ionic dicarboxylic acid contains a sulfonic acid group or its metal salt. Examples include the sodium, lithium, or potassium salt of sulfoterephthalic acid, sulfonaphthalene dicarboxylic acid, sulfophthalic acid, and sulfoisophthalic acid or their functional equivalent anhydride, diester, or diacid halide. Most preferably the ionic dicarboxylic acid repeat unit is provided by 5-sodiosulfoisophthalic acid or dimethyl 5-sodiosulfoisophthalate.

The nonionic dicarboxylic acid repeat units are provided by dicarboxylic acids or their functional equivalents represented by the formula:

$$-\overset{\overset{\displaystyle O}{\|}}{C}-R-\overset{\overset{\displaystyle O}{\|}}{C}-$$

where R is an aromatic or aliphatic hydrocarbon or contains both aromatic and aliphatic hydrocarbons. Exemplary compounds include isophthalic acid, terephthalic acid, succinic acid, adipic acid, and others.

Suitable diols are represented by the formula: HO-R-OH, where R is aromatic or aliphatic or contains both aromatic and aliphatic hydrocarbons. Preferably the diol incudes one or more of the following: ethylene glycol, diethylene glycol, or 1,4-cyclohexanedimethanol.

The polyesterionomer dispersions comprise from about 1 to about 25 mol percent, based on the total moles of dicarboxylic acid repeat units, of the ionic dicarboxylic acid repeat units. The polyesterionomers have a glass transition temperature (Tg) of about 60° C. or less to allow the formation of a continuous film.

The film-forming polymeric particles, the non-film-forming polymeric particles or both type particles may include reactive functional groups capable of forming covalent bonds by intermolecular cross-linking or by reaction with a cross-linking agent (i.e., a hardener). Suitable reactive functional groups include: hydroxyl, carboxyl, carbodiimide, epoxide, aziridine, vinyl sulfone, sulfinic acid, active methylene, amino, amide, allyl, and the like.

The coating compositions in accordance with the invention may also contain suitable cross-linking agents that may effectively be used in the coating compositions of the invention including aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, and zirconium sulfate, and the like. The cross-linking agents may react with functional groups present on either the film-forming polymers, the non-film-forming polymers or on both.

Matte particles well known in the art may be used in the coating composition of the invention, such matting agents have been described in *Research Disclosure* No. 308, published Dec. 1989, pages 1008 to 1009. When polymeric matte particles are employed, the polymers may contain reactive functional groups capable of forming covalent bonds by intermolecular cross-linking or by reaction with a cross-linking agent (i.e., a hardener) in order to promote improved adherence to the film-forming and non-film-forming polymers of the invention. Suitable reactive functional groups include: hydroxyl, carboxyl, carbodiimide, epoxide, aziridine, vinyl sulfone, sulfinic acid, active methylene, amino, amide, allyl, and the like.

The coating compositions of the present invention may also include lubricants or combinations of lubricants to reduce sliding friction of the photographic elements in accordance with the invention. Virtually any type of water soluble or dispersible lubricants can be used. For example, (1) water soluble or dispersible paraffin or wax-like materials, including vegetable waxes, insect waxes, mineral waxes, petroleum waxes, synthetic waxes carnauba wax, as well as wax-like components that occur individually in these waxes, (2) perfluoro- or fluoro- or fluorochloro-containing materials, which include poly(tetrafluoroethylene), poly(trifluorochloroethylene), poly(vinylidene fluoride), poly(trifluorochloroethylene-co-vinyl chloride), poly(meth)acrylates containing fluoro or perfluoroalkyl side groups, and the like, (3) poly(meth)acrylates or poly(meth)acrylamides containing long alkyl side groups, (4) silicone lubricants including siloxane containing various (cyclo)alkyl, aryl, epoxypropylalkyl, polyoxyethylene, and polyoxypropylene side groups, and the like.

The above lubricants also may contain reactive functional groups such as hydroxyl, carboxyl, carbodiimide, epoxide, aziridine, vinyl sulfone, sulvinic acid, active methylene, amino, and amide. The amount of lubricants can be incorporated in the coating composition in an amount from 0.1 to 150 mg/m$^2$, preferably from 0.1 to 90 mg/m$^2$.

Any of the reactive functional groups of the polymers and any of the cross-linking agents described in U.S. Pat. No. 5,057,407 and the patents cited therein may be used in accordance with this invention.

Any suitable antistatic agent may be added to the light-absorbing layer, such as a wide variety of types of metal-containing particles, polymer particles including crosslinked vinyl benzyl quaternary ammonium polymer particles as described in U.S. Patent No. 4,070,189, conductive materials described in U.S. Pat. Nos. 4,237,174, 4,308,332 and 4,526,706 in which a cationically stabilized latex particle is associated with a polyaniline acid addition salt semiconductor.

Suitable electrically-conductive metal-containing particles include donor-doped metal oxides, metal oxides containing oxygen deficiencies, and conductive nitrides, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN and ZrC.

Particular preferred metal oxides for use in this invention are antimony-doped tin oxide, aluminum-doped zinc oxide, niobium-doped titanium oxide, metal antiomonate as described in commonly assigned U.S. Pat. No. 5,368,995.

In the imaging elements of this invention, the electrically-conductive fine particles preferably have an average particle size of less than one micrometer, more preferably of less than 0.3 micrometers, and most preferably of less than 0.1 micrometers. It is also advantageous that the electrically-conductive fine particles exhibit a powder resistivity of $10^5$ ohm-centimeters or less.

The colloidal polymeric particles can be prepared either by emulsion polymerization or by emulsifying pre-formed polymers in water with a proper dispersing agent. In both cases, chain transfer agents including mercaptans, polymercaptans, and halogen compounds can be sued in the polymerization mixture to moderate the polymer molecular weight. The average molecular weight of prepared polymers may vary from 5,000 to 30,000,000 and preferably from 50,000 to 10,000,000.

The absorbing dye impregnated polymers can be made by any processes well known in the art. They can be made, for example, by mixing dye or dye solution with polymer latices in water as described in U.S. Patent Nos. 4,199,363, 4,203,716, and 4,990,435, or by dispersing a dye solution containing polymers in water such as described in European Patent Application No. 528,435, or by dispersing copolymers containing absorbing dye monomers in water, or by emulsion or suspension polymerization of dye-monomer mixture in water.

The dyes for the present invention may be conventional dyes. The structures of these dyes include arylidene compounds, heterocyclic arylidene compounds, anthraquinones, triarylmethanes, azomethine dyes, azo dyes, cyanine dyes, merocyanine dyes, oxonol dyes, styryl dyes, phthalocyanine dyes, and indigo dyes. Such dyes have been described in further detail in *Research Disclosure* No. 308, published December 1989, page 1003. The dyes for use in the present invention are preferably water insoluble.

The compositions of the present invention may be applied as aqueous coating formulations containing up to about 50 percent total solids by coating methods well known in the art. For example, hopper coating, gravure coating, skim pan/air knife coating, spray coating, and other methods may be used with very satisfactory results. The coatings are dried at temperatures up to 150° C. to give dry coating weights of 20 mg/m$^2$ to 10 g/m$^2$.

The invention is applicable to thermal imaging elements wherein the dye containing coalesced layer may be employed as supports, dye-donor elements, dye-image receiving layers, barrier layers, overcoats, binders and the like, as described in U.S. Pat. Nos. 5,288,689; 5,283,225; 4,772,582; and 5,166,128; and incorporated herein.

The invention is further illustrated by the following examples in which parts and percentages are by weight unless otherwise stated. Polymeric particles used in the example coatings together with the film-forming characteristic of each polymer is defined by the test set forth above.

TABLE 1

| Polymer | Polymer Composition | Tg,°C. | Description |
|---|---|---|---|
| P-1 | methyl methacrylate/methacrylic acid 97/3 | 110 | non-film-forming |
| P-2 | ICI Neorez 960 polyurethane dispersion | 10 | film-forming |
| P-3 | styrene-butyl methacrylate-sodium methacryloyl-oxyethyl-1-sulfonate (30/60/10) impregnated with 3-di-n-hexylaminoallylidenemalononitrile polymer/dye = 3/1 | | film-forming dye-impregnated polymer |
| P-4 | styrene-sodium methacryloyl-oxyethyl-1-sulfonate (95/5) impregnated with propyl-2-3-(-4-methoxyphenyl)-2- | | film-forming dye-impregnated |

TABLE 1-continued

| Polymer | Polymer Composition | Tg,°C. | Description |
|---|---|---|---|
| | propenoate) polymer/dye = 3/1 | | polymer |
| P-5 | ethyl methacrylate-sodium methacryloyl-oxyethyl-1-sulfonate (95/5) impregnated with propyl-2-3-(-4-methoxyphenyl)-2-propenoate) polymer/dye = 3/1 | | film-forming dye-impregnated polymer |
| P-6 | ethyl methacrylate-sodium methacryloyl-oxyethyl-1-sulfonate (95/5) impregnated with 3-di-n-hexylaminoallylidenemalononitrile polymer/dye = 3/1 | | film-forming dye-impregnated polymer |
| P-7 | ethyl methacrylate-methacrylic acid (91/9) impregnated with 3-di-n-hexylamino-allylidenemalononitrile polymer/dye = 2.2/1 | | film-forming dye-impregnated polymer |
| P-8 | methyl methacrylate-methacrylic acid (97/3) impregnated with 3-di-n-hexylamino-allylidenemalononitrile polymer/dye = 20/1 | | non-film-forming, dye-impregnated polymer |

EXAMPLE 1–3 AND COMPARATIVE SAMPLE A AND B

The following examples demonstrate that the coating compositions of the present invention do not change the wavelength of absorption maximum, but surprisingly increase the dye optical density in the coatings so as to maximize the power of the dye to protect imaging elements. Aqueous solutions containing various amounts of solids were applied onto polyethylene terephthalate support that had been subbed with a terpolymer latex of acrylonitrile, vinylidene chloride, and acrylic acid. The solids were adjusted so as to achieve a constant coating weight of the dye of about 107 mg/m$^2$. The coatings were dried at 90° C. for a minute to give transparent films. The optical density of the coatings was measured on a Hewlett Packard 8452A Diode Array Spectrophotometer. The results are listed in Table 2. Comparison of the data for Sample A with Examples 1 and 2 and Sample B with Example 3 demonstrates the increased optical density obtained for coatings of the invention even though the coating weight of dye is equal to that in the comparative samples.

TABLE 2

| Coating | Description | Optical Density (370 nm) |
|---|---|---|
| Sample A | p-3, 430 mg/m$^2$ | 1.25 |
| Example 1 | p-3/p-1 40/60, 1076 mg/m$^2$ | 1.70 |
| Example 2 | p-3/p-1/p-2 40/50/10, 1076 mg/m$^2$ | 1.70 |
| Sample B | p-6,430 mg/m$^2$ | 1.50 |
| Example 3 | p-6/p-1/p-2 40/50/10, 1076 mg/m$^2$ | 1.80 |

EXAMPLE 4–10 AND COMPARATIVE SAMPLE C TO G

The following examples demonstrate the excellent physical properties that are obtained with coating compositions of the present invention. Aqueous formulations comprising seven weight percent total solids were applied onto subbed polyethylene terephthalate support as described in Examples 1–3 and dried at 90° C. for a minute to give transparent films with a dry coating weight of 1076 mg/m$^2$. Taber abrasion tests (ASTM D1044) were carried out on these coatings and the description of the coatings and the results obtained are reported in Table 3.

TABLE 3

| Coating | Description | Taber Abrasion (% haze) |
|---|---|---|
| Sample C | Gelatin | 15 |
| Sample D | Gelatin/dye(D-1) 10/1 | 15 |
| Sample E | p-3 | 17.3 |
| Sample F | p-6 | 36.3 |
| Sample G | p-4 | 26.2 |
| Example 4 | p-3/p-1 40/60 ratio | 13.8 |
| Example 5 | p-3/p-1/p-2 40/50/10 ratio | 13.7 |
| Example 6 | p-6/p-1/p-2 40/50/10 | 10.0 |
| Example 7 | p-4/p-1/p-2 40/50/10 | 10.8 |
| Example 8 | p-5/p-1/p-2 40/50/10 | 7.8 |
| Example 9 | p-7/p-1/p-2 40/50/10 | 9.9 |

TABLE 3-continued

| Coating | Description | Taber Abrasion (% haze) |
|---|---|---|
| Example 10 | p-7/p-5/p-1/p-2 20/20/50/10 | 10.9 |

Dye D-1

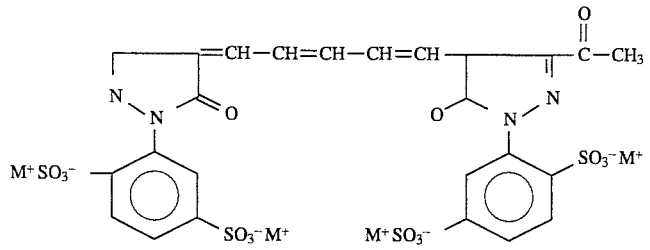

It can be seen that coatings of the invention provide superior abrasion resistance compared to gelatin coatings of the prior art and coatings comprising the dye impregnated polymer alone.

EXAMPLE 11–17 AND COMPARATIVE SAMPLE H TO J

The following examples show that the coating compositions of the invention provide void-free impermeable films that are comparable with organic solvent applied layers. A subbed polyester film support as previously described was coated with an aqueous antistatic formulation comprising 0.025 weight percent of silver-doped vanadium pentoxide, 0.075 weight percent of a terpolymer latex of methylacrylate, vinylidene chloride, and itaconic acid (15/83/2) and dried at 100° C. to yield an antistatic layer having a dry weight of about 8 mg/m$^2$. Aqueous coating compositions of the invention containing seven weight percent solids were applied over the antistatic layer and dried for 90 seconds at 100° C. to yield transparent coatings having a dry weight of 1076 mg/m$^2$. It is known (described in U.S. Pat. Nos. 5,006,451 and 5,221,598) that the antistatic properties of the vanadium pentoxide layer are destroyed after film processing if not protected by an impermeable barrier. Thus the permeability of the example coatings could be evaluated by measuring the antistatic properties of the samples after processing in conventional film developing and fixing solutions.

The samples were soaked in high pH (11.3) developing and fixing solutions as described in U.S. Pat. No. 4,269,929, at 38° C. for 60 seconds each and then rinsed in distilled water. The internal resistivity (using the salt bridge method, described in R. A. Elder, "Resistivity Measurements on Buried Conductive Layers", EOS/ESD Symposium Proceedings, Sep. 1990, pages 251–254) of the processed samples at 20 percent relative humidity was measured and compared with the internal resistivity before processing. The coating compositions and results are reported in Table 4.

TABLE 4

| Coating | Description | Resistivity Before Process log Ω/sq | Resistivity After Process log Ω/sq |
|---|---|---|---|
| Sample H | p-3 | 8.9 | 9.1 |
| Sample I | p-6 | 8.3 | 13.9 |
| Sample J | p-4 | 8.3 | 13.2 |
| Example 11 | p-3/p-1/p-2 40/50/10 ratio | 8.4 | 8.4 |
| Example 12 | p-6/p-1/p-2 40/50/10 ratio | 8.6 | 8.4 |
| Example 13 | p-4/p-1/p-2 40/50/10 ratio | 8.9 | 8.6 |
| Example 14 | p-7/p-1/p-2 40/50/10 ratio | 8.6 | 8.6 |
| Example 15 | p-6/p-4/p-1/p-2 20/20/50/10 ratio | 8.4 | 8.5 |
| Example 16 | p-7/p-4/p-1/p-2 20/20/50/10 ratio | 8.4 | 8.6 |
| Example 17 | p-8/p-2 70/30 ratio | 9.2 | 8.8 |

Coatings of the invention provide impermeable films that may serve as protective layers for antistatic coatings. At an equivalent dry coating weight comparative Samples I and J which feature only the dye-impregnated polymer do not protect an underlying antistatic layer during conventional film processing.

PREPARATION OF LATEX-INTERPOLYMER

A latex interpolymer (polymer used in P-3 listed in Table 1 for impregnation of 3-di-n-hexylaminoallylidenemalononitrile UV absorbing dye) having a composition of 30 mol % styrene, 60 mol % n-butyl methacrylate, and 10 mol % sodium 2-sulfoethyl methacrylate was prepared as follows: to a 1 L addition flask was added 225 mL of degassed distilled water, 14 mL of a 45% solution of Dowfax 2A1 in water (a branched $C_{12}$ alkylated disulfonated diphenyloxide surfactant sold by Dow Chemical), 68.9 g of styrene, 188 g of n-butyl methacrylate, and 42.8 g of sodium 2-sulfoethyl methacrylate. The mixture was stirred under nitrogen. To a 2 L reaction flask was added 475 mL of degassed distilled water and 14 mL of 40% Dowfax 2A1. The flask was placed in a 80 degree C. bath. 3.0 g of potassium persulfate and 1 g of sodium metabisulfate were added, immediately followed by the contents of the addition flask over a period of 40 min. The flask was stirred at 80 degree C. under nitrogen for 2 hours and then cooled. The pH of the latex was adjusted to 7 with 10% sodium hydroxide. The latex was filtered to remove a small amount of coagulum to give 30% solids. An analogous method can be utilized to prepare the other latex polymers described.

IMPREGNATION OF POLYMER LATEX WITH ABSORBING DYES

In this procedure a polymer latex of known solids, typically 20 to 30% by weight, was heated with stirring to 70 to 80 degree C. The absorbing dye was heated until it reached its liquid state and was mixed with the polymer latex with a high shear device to generate a coarse emulsion. The emulsion was then passed through a high energy homogenizer at least once at 70°–80 degree C. The final dye-impregnated latex polymer dispersion was allowed to cool to room temperature with stirring. The quality of dye impregnated latex polymer dispersion was tested by microscopic evaluation and particle sizing techniques to check for large dye particles or crystallized materials which were not incorporated into the polymer particles. Typical polymer to dye ratio ranges from 1:1 to 100:1. The mechanical impregnating can be assisted with a permanent solvent or an auxiliary solvent in case the dye has a higher melting point. The auxiliary solvent can be removed after the homogenization step. The absorbing dye impregnated polymer dispersions, film-forming dispersion, and non-film-forming dispersion are listed in Table 1.

What is claimed is:

1. An imaging element comprising a support, at least one light-sensitive layer and at least one light-absorbing layer, said light-absorbing layer comprising a coalesced layer of film-forming colloidal polymeric particles and non-film-forming colloidal polymeric particles, at least the film-forming colloidal polymeric particles or the non-film-forming colloidal polymeric particles contains a light-absorbing dye.

2. The imaging element of claim 1 wherein the light-absorbing dye is present in the film-forming colloidal polymeric particles.

3. The imaging element of claim 1 wherein the light-absorbing dye is present in the non-film-forming colloidal polymeric particles.

4. The imaging element of claim 1 wherein the film-forming colloidal polymeric particles are present in the coalesced layer in an amount of from 20 to 70 percent by weight based on the total weight of the layer.

5. The imaging element of claim 4 wherein the film-forming colloidal polymeric particles are present in the coalesced layer in an amount of from 30 to 50 percent by weight.

6. The imaging element of claim 1 wherein the light-sensitive layer is a silver halide emulsion layer.

7. The imaging element of claim 1 wherein the light-sensitive layer is a thermal imaging layer.

8. The imaging element of claim 1 wherein the light-absorbing layer contains an antistatic agent.

9. The imaging element of claim 1 wherein the light-absorbing layer overlies an antistatic layer.

10. The imaging element of claim 1 wherein the film-forming colloidal polymeric particles or the non-film-forming colloidal polymeric particles are crosslinked.

11. A coating composition for applying a light-absorbing layer which comprises a continuous aqueous phase having dispersed therein film-forming colloidal polymeric particles and non-film-forming colloidal particles, at least the film-forming colloidal polymeric particles or the non-film-forming colloidal polymeric particles contains a light-absorbing dye.

12. The coating composition of claim 11 wherein the film-forming polymeric particles are present in an amount of form 20 to 70% by weight based on the total weight of the film-forming and non-film-forming polymeric particles.

13. The coating composition of claim 12 wherein the film-forming polymeric particles are present in the amount of from 30 to 50% by weight.

14. The coating composition of claim 11 wherein the film-forming and non-film-forming polymeric particles have average particle size of from 10 to 500 nm.

15. The coating composition of claim 14 wherein the average particle size is from 10 to 200 nm.

16. The coating composition of claim 11 wherein the light-absorbing dye is present in the film-forming colloidal polymeric particles.

17. The coating composition of claim 11 wherein the light-absorbing dye is present in the non-film-forming colloidal polymeric particles.

* * * * *